US005104715A

United States Patent [19]

Cruz

[11] Patent Number: 5,104,715

[45] Date of Patent: * Apr. 14, 1992

[54] TILE FORMED OF COMPOSITE SHEET WITH INSULATING BOARD

[76] Inventor: Francisco A. Cruz, 35 Booth Street, Annandale, New South Wales, Australia, 2038

[ * ] Notice: The portion of the term of this patent subsequent to May 30, 2006 has been disclaimed.

[21] Appl. No.: 530,403

[22] Filed: May 30, 1990

Related U.S. Application Data

[63] Continuation-in-part of Ser. No. 357,764, May 26, 1989, abandoned, which is a continuation-in-part of Ser. No. 216,193, Jul. 7, 1988, Pat. No. 4,835,034.

[51] Int. Cl.[5] ..... B32B 3/10; B32B 7/04

[52] U.S. Cl. ..... 428/131; 156/250; 156/257; 428/136; 428/137; 428/138; 428/139; 428/140

[58] Field of Search ..... 428/137, 139, 140, 167, 428/131-136, 138; 156/250, 257

[56] References Cited

U.S. PATENT DOCUMENTS

| | | | |
|---|---|---|---|
| 3,649,431 | 3/1972 | Parker | 428/137 |
| 3,712,846 | 1/1973 | Daniels et al. | 428/141 |
| 4,039,706 | 8/1977 | Tajima et al. | 428/131 |
| 4,599,258 | 7/1986 | Hageman | 428/139 |
| 4,766,024 | 8/1988 | Nath et al. | 428/139 |
| 4,835,034 | 5/1989 | Cruz | 428/131 |

*Primary Examiner*—William J. Van Balen
*Attorney, Agent, or Firm*—James R. Gaffey

[57] ABSTRACT

An insulating board is formed of a low density insulating material, such as polystyrene foam. The board has apertures therein and a plurality of slots on its upper and its lower surfaces, the slots in the lower surface being offset from those in the upper surface. A high density material, such as gypsum or artificial resin or a cement fills the apertures and slots and extends over the upper and the lower surfaces of the board and, if desired, over it edges to form a composite sheet. Sheets of paper, plastic or metal may be fixed to the top and to the bottom of the composite sheet. A tile may be provided by affixing a planar sheet or the like to the top side of the composite sheet, the planar sheet, when in place, conforming to the upper surface of the composite sheet. A method of making the sheet involves bringing the board of low density material into contact with the material of higher density and allowing it to set or cure. The method of producing the composite sheet involves filling the apertures and slots on the insulating board with the high density material so as to cover at least one of the upper or lower surface thereof. The depth of the slots are at least slightly greater than the thickness of the board. Some or all of the apertures are defined by intersections between slots in the upper and lower surfaces of the board.

30 Claims, 6 Drawing Sheets

TILE FORMED OF COMPOSITE SHEET WITH INSULATING BOARD

CROSS REFERENCE TO RELATED APPLICATIONS

This application is a continuation-in-part of copending application Ser. No. 357,764 filed May 26, 1989, now abandoned, which is a continuation-in-part of application Ser. No. 216,193 filed Jul. 7, 1988, now U.S. Pat. No. 4,835,034, the disclosures of which are incorporated herein in their entireties by reference.

BACKGROUND OF THE INVENTION

The present invention relates to an insulation board, and to a composite sheet formed in part by the insulation board. The invention also is directed to a tile which is especially useful as a part of a roofing system for buildings and the like.

Many varied products are used by the building industry to line internal walls and ceilings in buildings, houses and the like. Some of these include gypsum board, fibrous plaster and low density particle boards, as well as construction members sold under the designations Villaboard and Masonite. Other products which are used by the building industry include internal tiles, external roof tiles, shingles and the like.

However, all the commonly used materials suffer at least one of the following drawbacks: (a) brittleness, (b) inability to withstand high humidity, (c) high weight/area ratio, (d) susceptibility to warpage, and (e) ineffective insulator.

SUMMARY OF THE INVENTION

It is therefore the object of the present invention to overcome or substantially ameliorate the above-mentioned problems.

According to a first embodiment of this invention there is provided an insulating board formed from a low density material and having an upper surface and a lower surface. At least one of the surfaces has a plurality of grooves or slots therein defining a plurality of areas of reduced thickness separated by areas of at least a given thickness of given thickness which is greater than the reduced thickness. A plurality of openings or apertures extend through the board, at least some of the apertures being coincident with at least some of the slots.

According to a second embodiment of this invention there is provided a composite sheet for use as a drywall board, lining, building construction member or the like, the composite sheet comprising an insulation board formed from a low density material, and a high density material applied to at least one side of the insulating board having a plurality of apertures therein. The board is formed of a low density material and has an upper surface and a lower surface, at least one of the surfaces having a plurality of grooves or slots therein. The slots define a plurality of areas of reduced thickness separated by areas of given thickness which is greater than the reduced thickness. At least some of the apertures are coincident with at least some of the slots. A material of higher density than the density of the board is applied to at least one of the upper and lower surface and extends through the apertures and fills the slots.

According to a third embodiment of the invention a tile, such as a roofing tile, includes the composite sheet described in the preceding paragraph which has a formed sheet affixed to the top side of the composite sheet. The formed sheet may be a flexible planar sheet which, when in place, conforms to the top side of the composite sheet.

According to a fourth embodiment of this invention there is provided a process for producing the composite sheet of the second embodiment comprising applying high density material to at least one side of the insulation board of the first embodiment and filling the apertures and slots with the high density material. The fourth embodiment may include applying the high density material to both major sides of the board. The fourth embodiment may further comprise affixing a formed sheet to the top side of the composite sheet to form a tile.

Preferred embodiments and variants of the present invention to which this continuation-in-part application particularly relate are set out in the appended method and component claims.

Preferred forms of the present invention are described herein below by way of example with reference to the accompanying drawings.

DETAILED DESCRIPTION OF THE PREFERRED EMBODIMENTS

Figure 1:
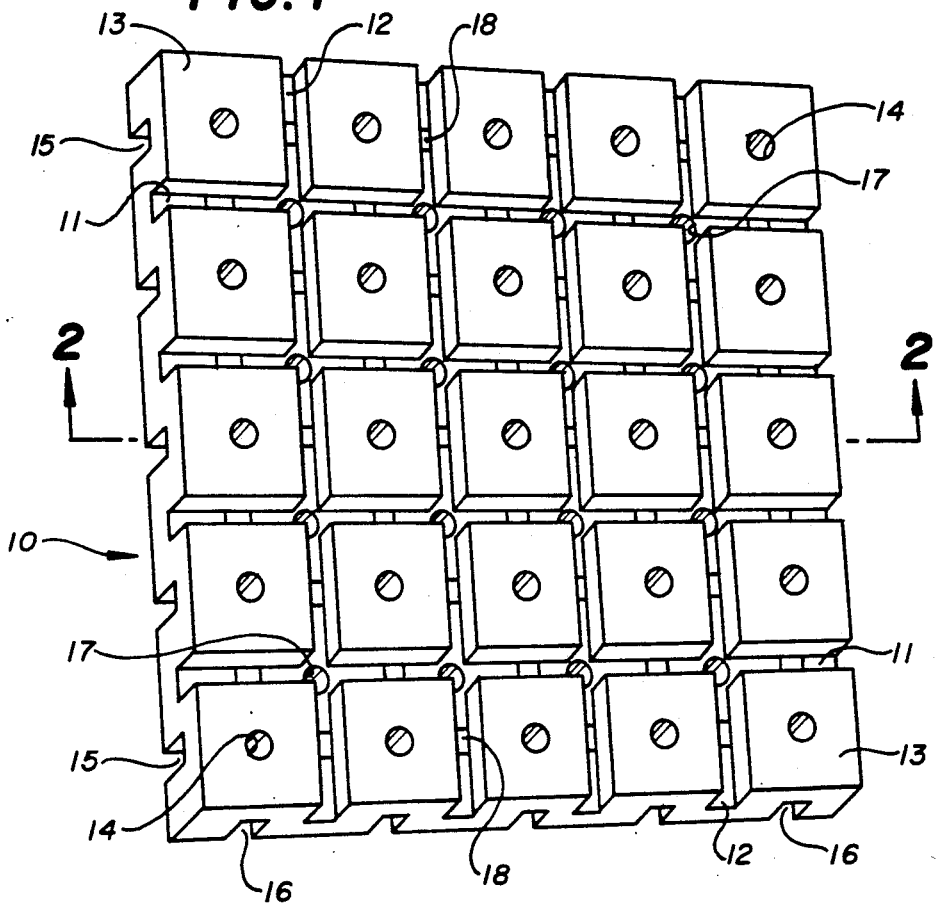
FIG. 1 is a perspective view of a formed low density insulation board construction in accordance with a first exemplary embodiment of the present invention.

In FIG. 1 of the accompanying drawings there is schematically depicted a formed low density insulation board 10, preferably made of polystyrene foam. The board 10 is provided on its top surface with a first plurality of spaced apart slots 11 and a second plurality of spaced apart slots 12, the slots 11 being perpendicular to the slots 12. The slots 11 and 12 can be considered to be respective first and second groups of slots of a single plurality. The slots 11 and 12 define a plurality of upstanding members 13, having generally square, flat upper surfaces. In the preferred embodiment shown in FIG. 1, each of the members 13 is provided with a circular aperture 14 which opens into respective ones of a third plurality of spaced-apart parallel slots 15 which are in the lower surface of the board 10 and the apertures 14. In the lower surface of the board 10, a fourth plurality of spaced-apart parallel slots 16 is provided, these slots also being coincident with the apertures 14. The slots 15 and 16 can be considered to be respective first and second groups of slots of a single plurality. The slots 16 in the bottom surface of the board 10 run perpendicular to the slots 15. It is to be understood that the third and fourth pluralities of slots 15 and 16 define a plurality of members (like the members 13 in the upper surfaces) having a generally square, flat lower surface provided with respective circular apertures 17 which open into the respective ones of the slots 11 at the intersections between the slots 11 and 12. The depths of the slots 11, 12, 15 and 16 are slightly greater than the thickness of the board so that a plurality of respective apertures 18 of generally rectangular or square cross section are defined midway between each pair of apertures 17 and each pair of adjacent apertures 14.

Figure 2:
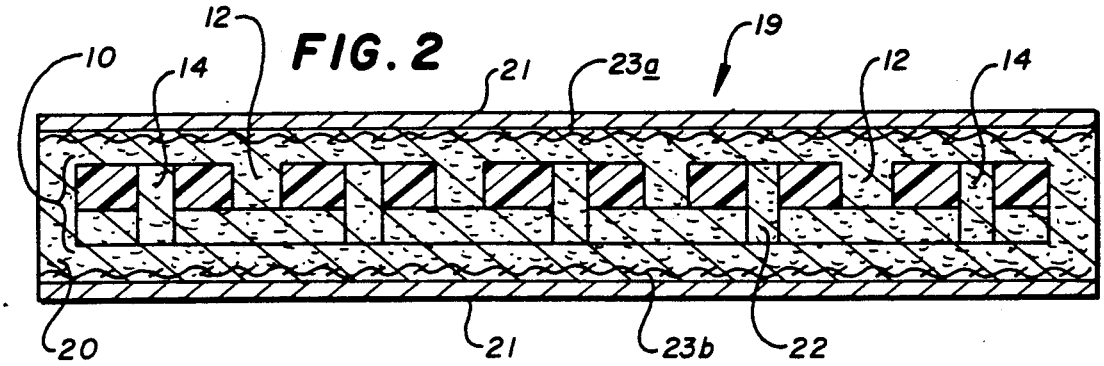
FIG. 2 is a cross sectional view of a portion of a composite sheet incorporating the formed low density insulation board of FIG. 1, in accordance with a second exemplary embodiment, the section having been taken through the insulating board of FIG. 1 along section line 2—2.

The board 10 can be used in combination with a material of higher density, such as for example as illustrated in FIG. 2, calcined gypsum 20 (i.e., plaster of Paris), with paper sheets 21 or the like applied to the upper and lower surfaces to provide a composite sheet 19 for lining walls and/or ceilings. Either one or both of the paper sheets 21 could be replaced, if desired, with respective sheets of plastic or metal fixed to the respective upper and lower surfaces of the board 10, were it desired to use the sheet as a tile or the like. In some instances, the sheets 21 need not be present. It is to be understood that the calcined gypsum 20 could extend along the edges of the board 10, as illustrated, in effect encapsulating the board and providing some protection for the board.

To make the sheet 19, unset calcined gypsum plaster 20 is applied to both the top and bottom surfaces of the board 10. The plaster 20 fills the apertures 14, 17 and 18 and the slots 11, 12, 15 and 16. A relatively thin layer of plaster 20 remains adjacent to both the top and bottom surfaces of the board 10. As mentioned above, the plaster 20 may extend along the edges of the board 10, protecting the board and adding additional strength. When dry the board 10 reinforces the plaster 20 and vice versa. The plaster 20 which extends through the apertures 14, 17 and 18 provides, in particular, considerable strength against compression forces; the plaster 20 in the slots 11, 12, 15 and 16 provides strength and resistance against bending of the sheet 19. The paper sheets 21 or the plastic or metal sheets which may be used in some applications add further strength to the sheet 19.

Further, reinforcing fibers 22 (e.g., fibre glass, hemp, coconut fibres, cotton fibres and the like) can be mixed with unset plaster 20 to further improve the qualities of the sheet. In place of the fibres 19 or, as an addition, scrims 23*a* and 23*b* made of mineral fibres, synthetic fibres or natural fibres, as noted above, could be provided on the top and/or bottom of the board. The scrims 23*a* and 23*b* of nonwoven material could be pressed into the upper and/or lower surface of the composite board before the high density material sets and before the sheets 21 are positioned. In some cases one or both of the sheets 21 need not be used.

Figure 3:
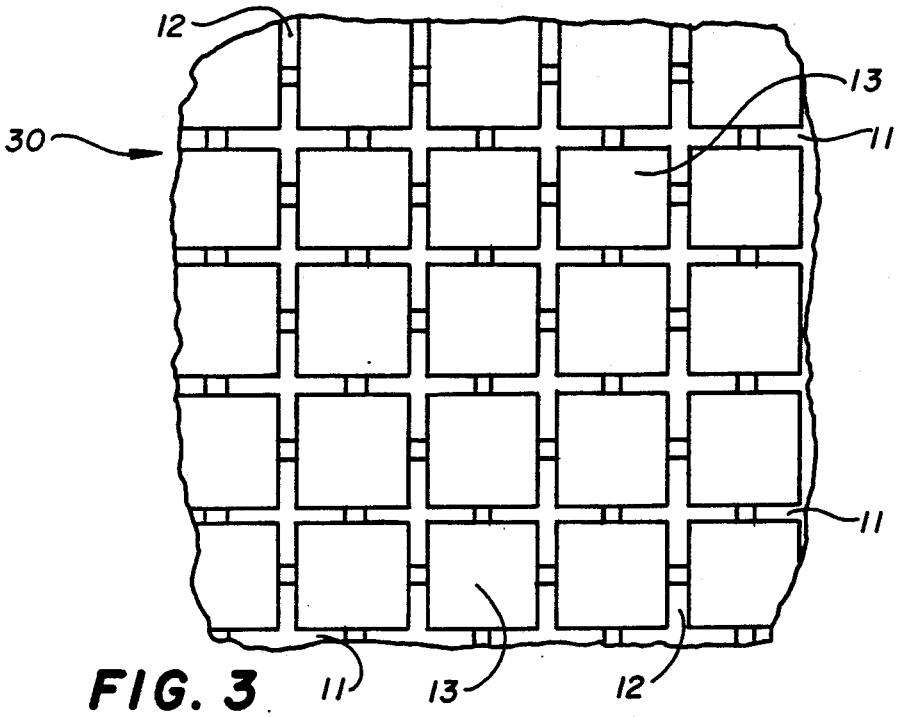
FIG. 3 is a top, plan view of a first variant of the first exemplary embodiment of the present invention.

In FIG. 3 of the accompanying drawings there is schematically depicted as a top, plan view, a formed low density insulation board 30, preferably made of polystyrene foam or the like. The board 30, like the board 10 (FIG. 1), is provided in its top surface with a first plurality of spaced-apart slots 11 and a second plurality of spaced-apart slots 12 which are perpendicular to the slots 11. The slots 11 and 12 have depths which are slightly greater than one-half the thickness of the board 30. The slots 11 and 12 define a plurality of upstanding members 13 having generally square, flat upper surfaces.

The bottom surface of the board 30 is provided with third and fourth pluralities of slots (not visible in FIG. 3) which have depths slightly greater than the thickness of the board 30. The respective pluralities of slots in the bottom surface are, with respect to the pluralities of slots 11 and 12, offset one-half the distance between the slots 11 and the slots 12, like the preferred embodiment as illustrated in FIG. 1. As a result of spacing, the offset and the depths of the slots, an array of generally rectangular or square apertures 18 are provided. Thus, the variant, as illustrated in FIG. 3, can be considered to correspond to the first embodiment shown in FIG. 1 without apertures 13 and 17.

It is to be understood that insulation board 30 shown in FIG. 3 can be incorporated into a composite sheet having a construction much like the composite sheet shown in FIG. 3, sans the apertures 13 and 17 (FIGS. 1, 2).

Figure 4:
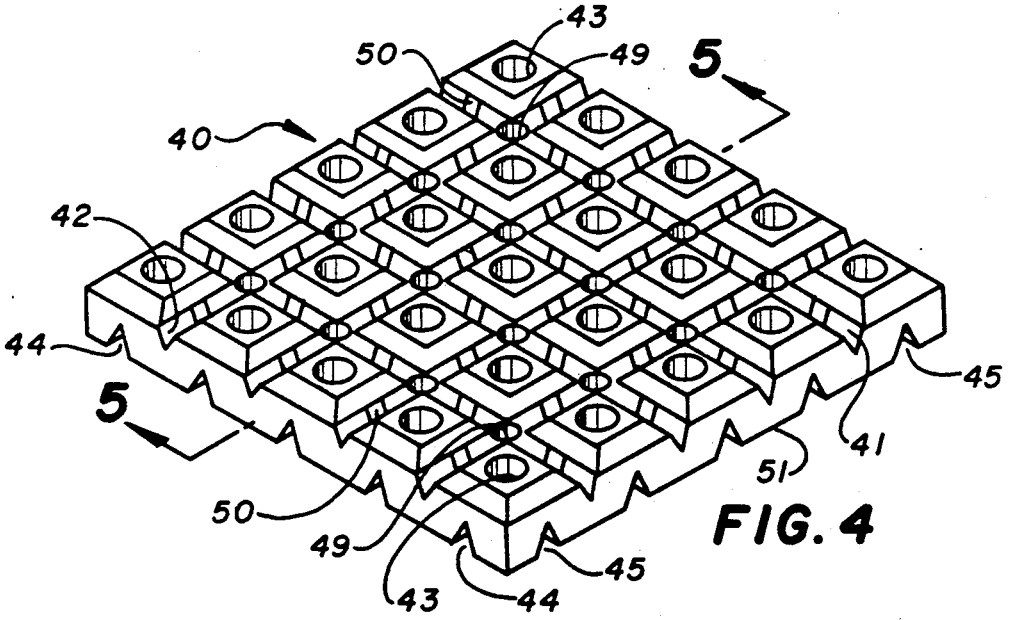
FIG. 4 is a perspective view of a formed low density insulation board constructed in accordance with a second variant of the first exemplary embodiment of the present invention.

In FIG. 4 of the accompanying drawings there is schematically illustrated, as a second variant, an insulating board 40 provided with a first plurality of circular apertures 43 arranged in an array. The apertures 43 are preferably bored through the board 40, but could be formed using any number of conventional techniques. The preferred variant shown in FIG. 4 includes a plurality of spaced-apart parallel slots 41, of triangular cross section, in the upper surface of the board 40 between rows of the apertures 43 and a second plurality of spaced-apart parallel slots 42 between columns of the apertures 43. The slots 42 run perpendicular to the slots 41 and, like the slots 41, are of triangular cross section. The slots 41 and 42 have depths which are slightly greater than one-half the thickness of the board 40 and define respective truncated pyramids having flat, square distal surfaces. In the lower surface of the board 40, a third plurality of spaced-apart parallel slots 44 of triangular cross section and a fourth plurality of spaced-apart slots 45 of triangular cross section are provided, these pluralities of slots being respectively coincident with the rows and columns of the array of apertures 43. The slots 44 and 45 also have depths which are slightly greater than one-half the thickness of the board 40. The slots 41 and 42 in the bottom surface of the board 40 define members 51 having generally flat, square distal surfaces (like those defined in the top surface), and also have the shape of truncated pyramids. Each of the members 51 has a respective aperture 49 therein which extends through the board 40 and opens into respective intersections between the slots 41 and 42. The apertures 43 open into respective intersections between the slots 44 and 45. Thus, the top and bottom of the board 40 have similar appearances. Inasmuch as the slots 41, 42, 44 and 45 have depths greater than the thickness of the board 40, a plurality of rectangular or square apertures 50 are defined at each intersection between a slot 42 with a slot 44 and at each intersection between a slot 41 with a slot 45.

Figure 5:
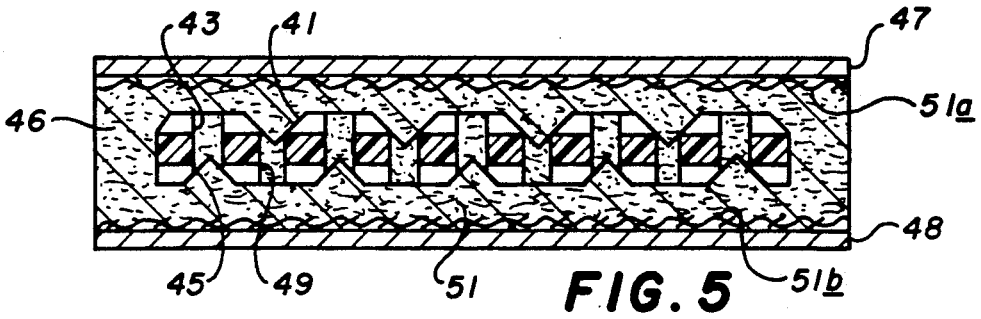
FIG. 5 is a cross sectional view of a portion of a composite sheet incorporating the formed low density insulation board of FIG. 4, in accordance with a variant of the second embodiment of the invention, the section having been taken through the insulating board of FIG. 3 along section line 4—4.

The board 40 can be used in combination with a material of higher density, such as for example as illustrated in FIG. 5, calcined gypsum 46 (i.e., plaster of Paris), with respective paper sheets 47 and 48 or the like applied to the upper and lower surfaces to provide a composite sheet for lining walls and/or ceilings. Either one or both of the paper sheets 47 and 48 could be replaced, if desired, with respective sheets of plastic or metal fixed to the upper and lower surfaces of the composite sheet, were it desired to use the sheet as a tile, shingle or the like. It is to be understood that the calcined gypsum 46 could extend along the edges of the board 40, providing some protection for the board and encapsulating it.

To make the sheet illustrated in FIG. 5, unset calcined gypsum plaster 46 is applied to both the upper and lower surfaces of the board 40. The plaster 46 fills the apertures 43, 49, and 50, and the slots 41, 42, 44 and 45. A relatively thin layer of plaster 46 remains adjacent to both the upper and lower surfaces of the board 40. The plaster 46 may extend along the edges of the board 40, protecting the board and adding additional strength. The plaster 46 which extends through the apertures 43, 49 and 50 provides, in particular, considerable strength against compression forces; the plaster 46 in the slots 41, 42, 44 and 45 provides strength and resistance to bending and twisting forces. The paper sheets 47 and 48 or the plastic or metal sheets which may be used in some applications add further strength to the composite sheet of FIG. 5.

As in the case of FIG. 2, natural and/or synthetic reinforcing fibres (e.g., fibre glass, hemp, polypropylene, coconut fibres, cotton fibres 51 and the like) can be mixed with the unset plaster 46 to further improve the qualities of the board in the same manner as the fibres 22 reinforce the composite sheet 22 (FIG. 2). In place of the fibres 51, or in addition thereto, scrims 51*a* and 51*b* made of metal fibres, synthetic fibres or natural fibres, as noted above, could be provided on the top or bottom of the board. The scrims 51*a* and 51*b* of nonwoven material could be pressed into the upper and/or lower surfaces of the composite board before the high density material sets and before the sheets 47 and 48 are positioned. In some cases the sheets 47 and 48 need not be used.

The composite sheet 19 of FIG. 2, as well as the variant shown in FIG. 5, is a sheet of lighter construction than present commonly used materials, and can be of equal, or greater strength. It is durable, and less likely to sag or warp in use.

The insulation boards of present invention can be configured in a number of different and distinct fashions, all of which involve pluralities of slots, having depths at least slightly greater than the thickness of the board. Apertures are defined by intersections of slots in the upper surface of the board with those in the lower surface.

Figure 6:
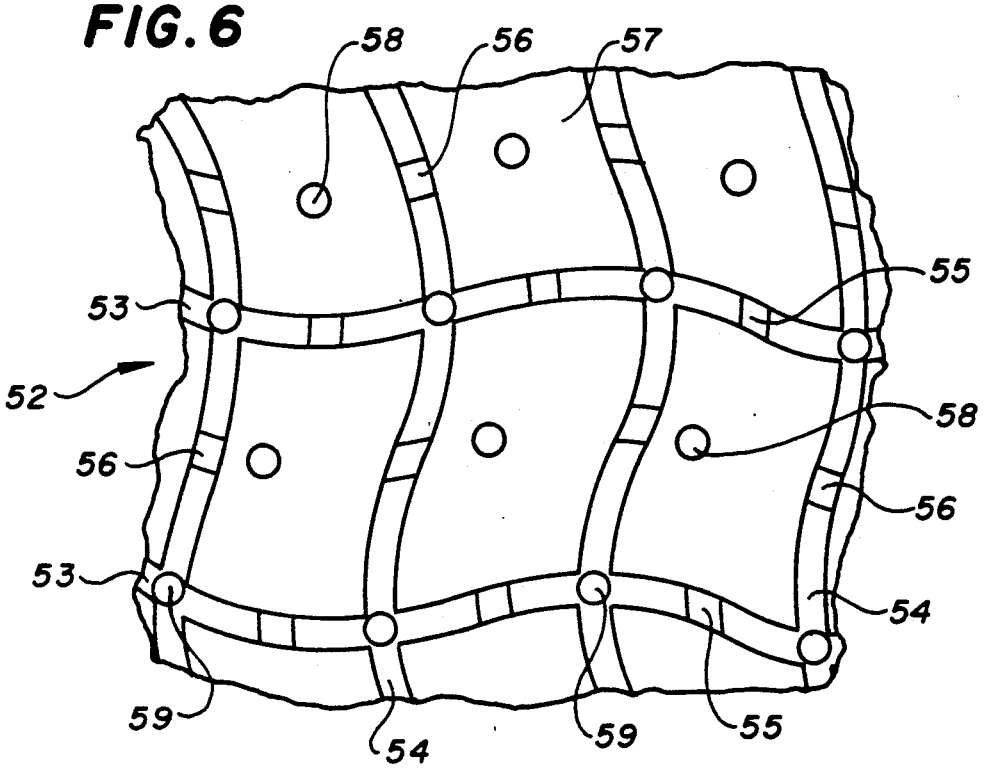
FIGS. 6–9 are respective top, plan views of respective formed low density insulation boards constructed in accordance with the present invention, the boards being variants of the first embodiment of the invention shown in FIG. 1.

Among the possible configurations in the variant of the insulating board 10 (FIG. 1) is shown in FIG. 6. The top, plan view of FIG. 6 is of an insulating board 52 provided in its visible upper surface a first plurality of spaced-apart slots 53 and a second plurality of spaced-apart slots 54. The slots 53 and 54 are carved from end-to-end, as are offset slots (not visible) in the lower surface of the board 52. The slots 53 and 54 and those in the bottom surface of the board 52 have depths which are at least slightly greater than the thickness of the board 52. Thus, pluralities of apertures 55 and 56 are provided at respective intersections between the slots 53 and 54 in the upper surface of the board 52 with the offset slots in the bottom surface. A number of upstanding members 57 are defined by the spaced-apart slots 53 and 54. A respective aperture 58 is provided in each of the members 57 and extends into one or another of the slots (not visible) in the bottom surface of the board 52. Similar upstanding members are defined by the slots (not visible) in the bottom surface of the board 52, respective apertures 59 being provided through the upstanding members in the bottom surface. The apertures 59 open into respective intersections between the slots 53 and 54.

Figure 7:
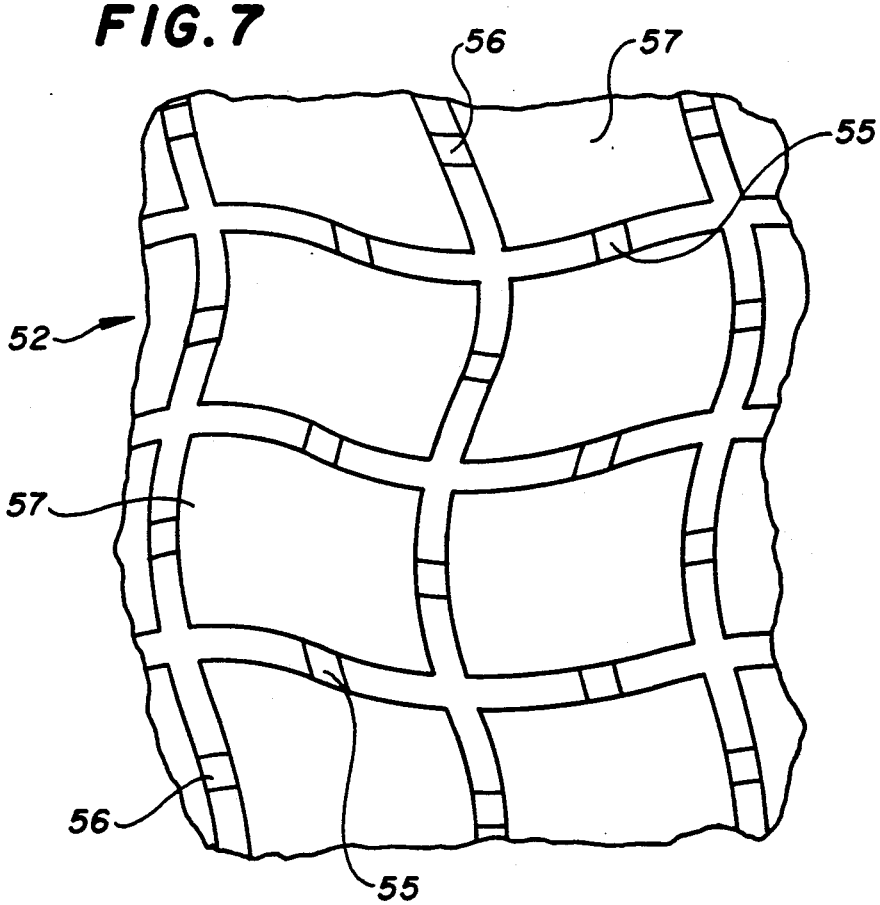

Another variant of the insulation board 10 (FIG. 1) is shown in FIG. 7. It corresponds closely to board 52 shown in FIG. 6, the only difference being that the board is free of the apertures 58 and 59.

Figure 8:
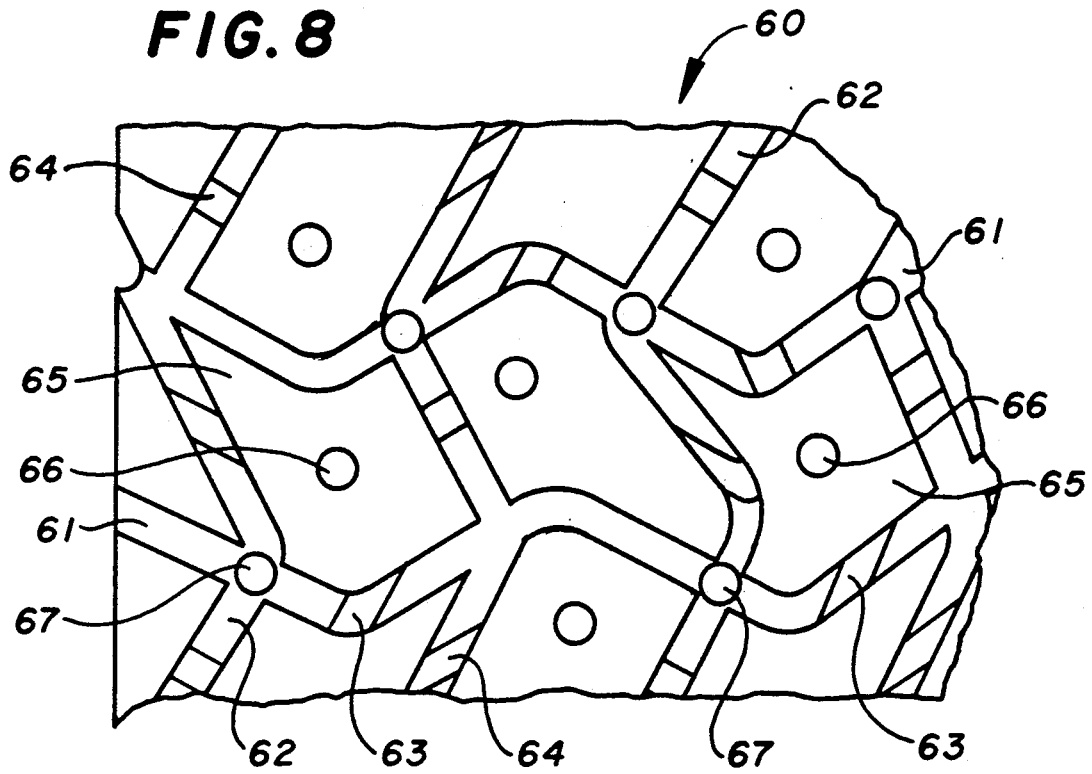

As shown in FIG. 8, a variant insulation board 60 having in its upper surface a first plurality of spaced-apart slots 61 of zig-zag configuration from end-to-end and a second plurality of spaced-apart slots 62 of zig-zag configuration from end-to-end, the slots 62 crossing the slots 61. Similar pluralities of slots (not visible) are provided in the lower surface of the board 60. The slots 61 and 62, as well as the slots in the lower surface, have depths which are at least slightly greater than one-half the thickness of the board 60. Inasmuch as the depths of the slots is greater than one-half the thickness of the board 60, a plurality of apertures 63 are defined at intersections between respective ones of the slots 61 with a corresponding slot in the lower surface. A plurality of respective apertures 64 are defined between intersections of respective ones of the slots 62 with a corresponding slot in the lower surface. The slots 61 and 62 in the upper surface define a plurality of upstanding members 65 in thee upper surface of the board 60, a similar set of upstanding members being defined in the lower surface by the offset pluralities of slots therein. Apertures 66 are provided in each of the upstanding members 65, each opening into a slot in the lower surface. The upstanding members in the bottom surface of the board 60 are also provided with respective apertures 67 which open into respective ones of the slots 61 and 62, generally at intersections between straight line segments.

Figure 9:
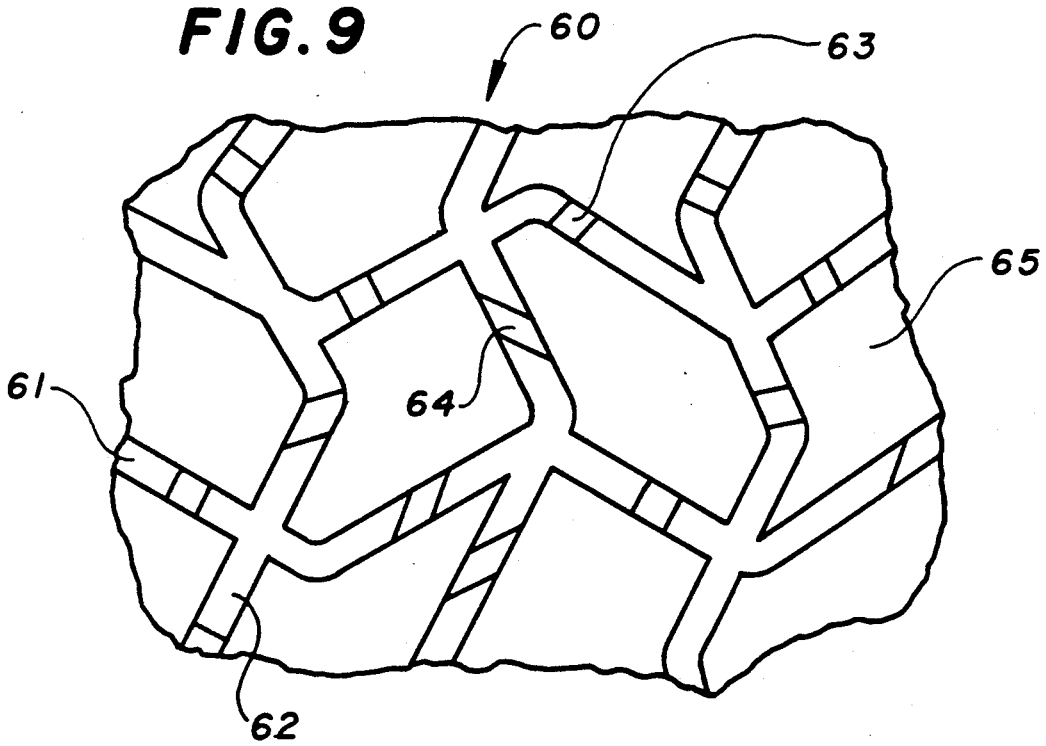

Yet another variant of the board 10 (FIG. 1) is shown in FIG. 9. In this case the insulation board 60 is constructed similarly to the board shown in FIG. 8, except that the board 60 does not have the generally circular apertures 66 and 67 therein.

The low density insulation boards shown in FIGS. 6–9 may be used in composite sheets by filling the slots and apertures therein with high density material and covering one or both of its upper and lower surfaces therewith. The scrim and/or fibre components may be added, as in the composite sheet shown in FIG. 2. Paper or metal sheets could also be present as part of the composite sheet. The boards shown in FIGS. 3 and 6–9 could also be used in tiles, including roofing tiles.

The polystyrene insulation board 10 of FIG. 1, as well as those illustrated in FIGS. 3 and 5–9, provides the composite sheets, in each case, with a relatively low coefficient of heat transfer (i.e., the plaster board has good insulative properties) and a high resistance to moisture absorption.

A number of composite sheets have been described wherein a polystyrene insulation board is incorporated in plaster material. However, the polystyrene insulation board can also be used in combination with a wide variety of other materials such as fast setting cement compositions to produce different types of composition sheets. For example, hydraulic cements such as: Portland cement, cements possessing qualities such as rapid hardening, low heat transfer, sulphate resisting (i.e., qualities due to additives); cement mixtures such as masonite cement, lime cements, selenitic cement, Pozzolanic cement, calcium sulphate cements, plastic-bonded cements; and cement with silica fillers; may be used in combination with the polystyrene (or other low density material) insulation boards. Moreover, a number of materials other than cements could be used. For example, a number of artificial resins (relative high density plastics) could be used in place of the plaster, such material in liquid form could be poured over the board, while it is held in a fixed position and allowed to cover the upper and lower surfaces of the board 10, as well as its edges if desired. The artificial resin then would be allowed to set or cure in place, encapsulating the respective boards illustrated in FIGS. 1, 3, 4 and 6–9 as the cases may be. This combination is very suitable for forming floor and/or roof tiles and the like.

Due to its lightness and strength, a composite sheet according to the present invention has a wide range of applications. Thus apart from use in or as ceilings, wall panels, partitions, etc., a composite sheet of the invention can be used as a flooring underlay, wall and ceiling insulation, artistic casting or pre-form support, an interior or exterior tile, or roofing member, depending on the selection of materials. Moreover, the shape of the board and resulting sheet could be chosen so that a plurality of the sheets could be interlocked and/or positioned adjacent to others of the same shape to provide a pleasing appearance and provide a modular approach to laying a floor, lining a wall or ceiling and roofing a building.

Figure 10:
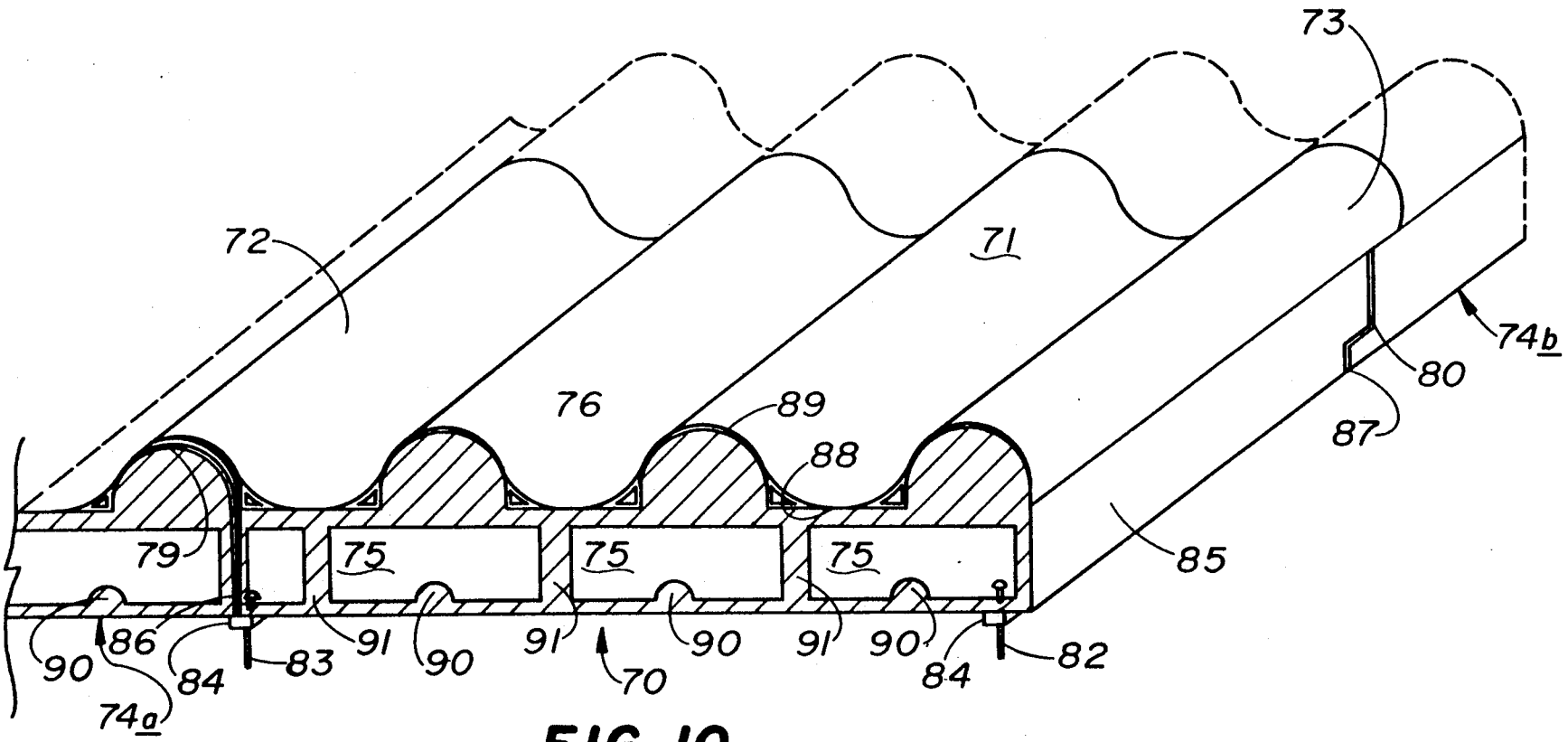
FIGS. 10 and 11 are pictorial illustrations, along respective section lines, showing an application of the present invention to a roofing tile system.
Figure 11:
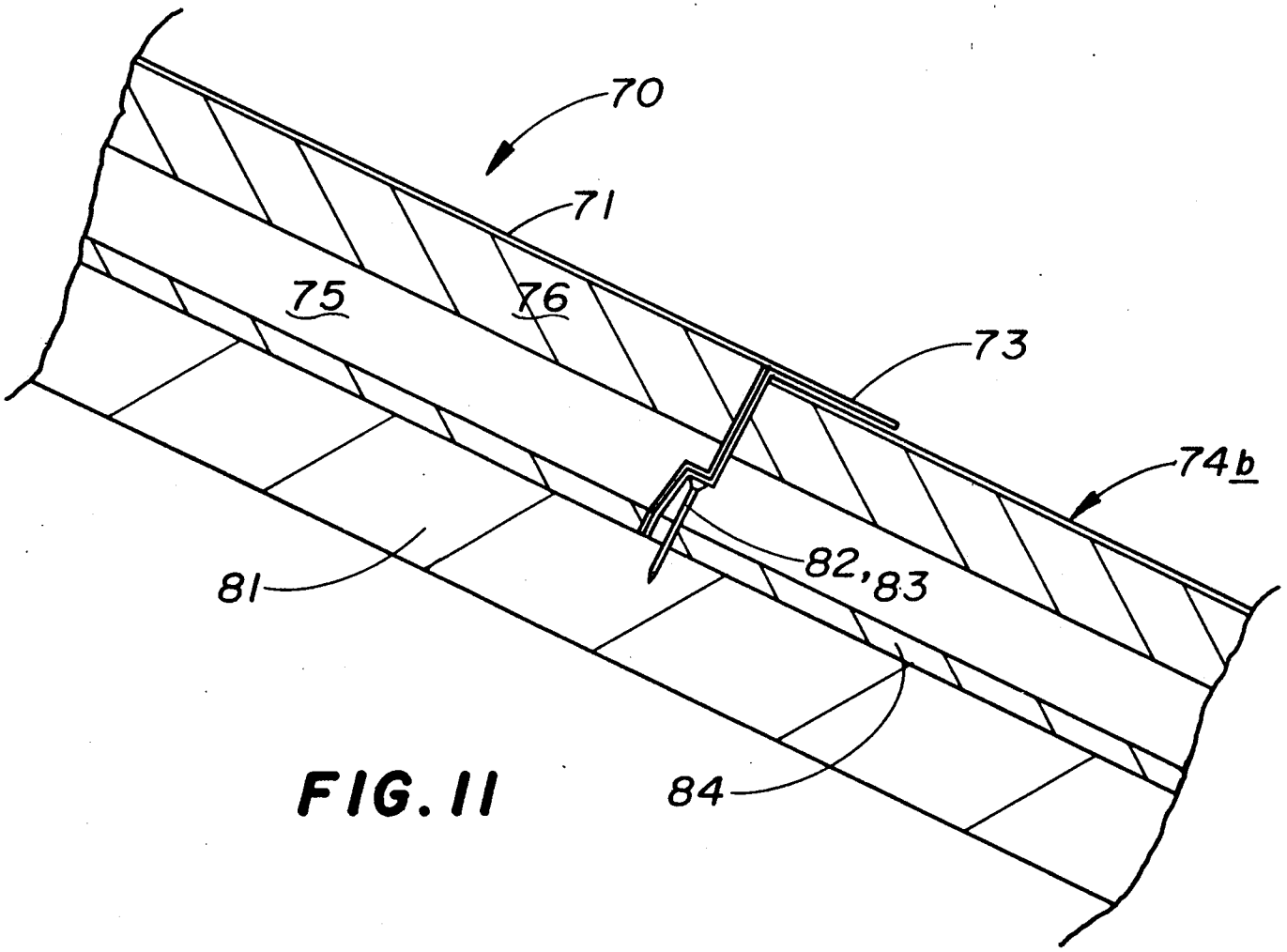

In particular, as depicted in FIGS. 10 and 11 by way of example, a roofing tile 70 which is adapted to interlock to provide a roofing tile system is shown in association with other features in accordance with a preferred embodiment of the present invention.

There is depicted a composite sheet construction provided with a formed corrugated upper sheet 71 made of, for example, plastic or metal. The formed sheet 71 is corrugated so that lateral overhanging portion 72 and longitudinal overhanging portion 73 can overlap adjacent tiles 74*a* and 74*b* respectively and cooperate therewith so as to be interlocked with tile 70.

Corrugated tile 70 depicted in FIG. 11 comprises an insulation board 75, a high density material such as, for example, calcined gypsum 76, and a water-resistant corrugated upper sheet 77. Each tile 70, 74*a* and 74*b* is generally rectangular with one edge having the sheet 71 extending beyond insulation board 75 and high density material 76 to define lateral overhanging portion 78. The lateral overhanging portion 72 is a semicylindrical corrugation which cooperates with corrugation 79 of an adjacent tile 74*a* to provide a water-proof connection. An end edge 80 of tile 70 has the sheet 71 extending beyond the insulation board 75 and high density material 76 to define the longitudinal overhanging portion 73 adapted to overlap the adjacent tile 74*b*. When the tiles 70, 74*a* and 74*b* are arranged on an inclined roof structure 81 (as depicted in FIG. 1 ), the longitudinal overhanging portion 73 overlaps the tile 74*b* so as to provide a weather-proof connection therebetween.

Tile 70 can be attached to roof structure 81 by fasteners 82 and 83 engaging edge projections 84 provided on edges 85 and/or 86 of the tile 70 opposite from longitudinal overhanging portion 73 and the lateral overhanging portion 72.

The tiles 70 further comprise recesses 87 disposed so as to receive each of the projections 84 when tiles 70, 74*a* and 74*b* are brought into abutting relationship.

Preferably, the underside of sheet 71 has flat surfaces 88 and semicircular profiled channels 89 whereby the material 76 filling the channels 90 and the interstices 91 of the insulation board 75 provides a positive connection therebetween. The undersides of portions 78 and 73 are provided with profiles which closely cooperate with the top side of adjacent tiles 74*a* and 74*b*.

In its method aspect, a preferred embodiment of the invention is a method of producing a composite sheet comprising providing an insulation board of low density material having apertures and slots in at least one of its upper surface or its lower surface. The method includes filling the apertures and the slots with a high density material so as to cover at least one the said upper surface and said lower surface.

The preferred method embodiment may include affixing a water-resistant formed planar sheet member to the top side of the composite sheet made in accordance with the preceding paragraph.

The preferred method embodiment may further comprise providing overhanging portions of the planar sheet along at least one side edge and one end edge of the composite sheet.

The preferred method embodiment may also include the step of forcing a scrim of metallic, synthetic and/or natural fibres into the upper and/or lower surface of the composite sheet before the high density material sets or hardens.

The preferred method may include the step of adding metallic, synthetic and/or natural fibres to the high density material before filling the apertures and slots and covering at least one of the upper and lower surfaces of the insulating board therewith.

The preferred method embodiment may further include providing at least one projection integral with the composite sheet at an edge thereof other than the one side edge or the one end edge, the projection being adapted to receive a fastener.

It is to be understood that the width of the slots in the low density material may vary from application to application. For example, the width of the slots may be about one-quarter of an inch in some cases and about two inches in others. The upstanding members can have different surface areas, depending on the particular application to which the insulation board is to be put. For example, in some applications, the areas could be about four square inches and in others about one square inch. In some instances, the board need not have slots which are greater in depth than one-half its thickness and the apertures from slot-to-slot would be absent, the apertures being provided from respective slots in the upper and lower surfaces through respective ones of the upstanding members in the upper and lower surfaces.

The composite sheet of the present invention can be large or small. In the case of a floor tile, the sheet could be of different shapes and sizes, for examples, the tile could be square or rectangular in shape and could have a major surface area of over two square feet or less than one-half a square foot or any areas therebetween. The composite sheet of the present invention, when as a drywall panel or the like, can be of such a size that it would extend from floor to ceiling and be of standard thicknesses, widths and lengths.

It is to be understood that the foregoing description and accompanying drawing figures relate to embodiments and to variants set out by way of example, not by way of limitation. Numerous other embodiments and variants are possible without departing from the scope of the invention, its scope being defined by the appended claims.

What is claimed is:

1. An article comprising an insulating board having a plurality of apertures therein, said board being formed of low density material and having an upper surface and a lower surface, said upper surface having a first plurality of slots therein defining a plurality of areas of reduced thickness separated by areas of at least a given thickness greater than said said reduced thickness, at least some of said apertures being coincident with at least some of said slots, and a second plurality of slots in said lower surface, wherein said board has a given thickness, wherein said slots have depths at least slightly greater than one-half said given thickness and wherein at least some of said apertures are defined by intersections between slots of said first and said second pluralities of slots.

2. The article of claim 1, wherein the first-said plurality of slots comprise a first group of spaced-apart, substantially straight slots in said upper surface and a second group of spaced-apart, substantially straight slots in said upper surface, said first group of straight slots being substantially perpendicular to said second group of spaced-apart slots.

3. The article of claim 2, wherein said second plurality of slots comprise a third group of spaced-apart, substantially straight slots in said lower surface and a fourth group of spaced-apart, substantially straight slots in said lower surface, said third group of straight slots being substantially perpendicular to said fourth group of straight slots.

4. The article of claim 1, wherein said plurality of slots comprise slots which are individually composed of connecting substantially straight line segments.

5. The article of claim 4, wherein at least some of said apertures are positioned at points of connection between said line segments.

6. The article of claim 4, wherein at least some of said apertures are positioned at points along the straight line segment other than at ends of said segments.

7. The article of claim 1, wherein said plurality of slots comprise slots which are individually curved or wave-shaped from end-to-end.

8. The article of claim 7, wherein at least some of said apertures are positioned at points of intersection between respective ones of said plurality of slots.

9. A composite sheet having a top side and including an insulating board having a plurality of apertures therein, said board being formed of low density material and having an upper surface and a lower surface, said upper surface having a first plurality of slots therein defining a plurality of areas of reduced thickness separated by areas of at least a given thickness greater than said reduced thickness, at least some of said apertures being coincident with at least some of said slots, a material of higher density than the density of the board applied to at least one of said upper surface and said lower surface and extending through said apertures and filling said slots, and a second plurality of slots in said lower surface, wherein said board has a given thickness, wherein said slots have depths at least slightly greater than one-half said given thickness and wherein at least some of said apertures are defined by intersections between slots of said first and said second pluralities of slots.

10. The article of claim 9, wherein the first-said plurality of slots comprise a first group of spaced-apart, substantially straight slots in said upper surface and a second group of spaced-apart, substantially straight slots in said upper surface, said first group of straight slots being substantially perpendicular to said second group of spaced-apart slots.

11. The article of claim 9, wherein said second plurality of slots comprise a third group of spaced-apart, substantially straight slots in said lower surface and a fourth group of spaced-apart, substantially straight slots in said lower surface, said third group of straight slots being substantially perpendicular to said fourth group of straight slots.

12. The article of claim 9, wherein said plurality of slots comprise slots which are individually composed of connecting substantially straight line segments.

13. The article of claim 12, wherein at least some of said apertures are positioned at points of connection between said line segments.

14. The article of claim 12, wherein at least some of said apertures are positioned at points along the straight line segment other than at ends of said segments.

15. The article of claim 9, wherein said plurality of slots comprise slots which are individually curved or wave-shaped from end-to-end.

16. The article of claim 15, wherein at least some of said apertures are positioned at points of intersection between respective ones of said plurality of slots.

17. A tile comprising a composite sheet having a top side and including an insulating board having a plurality of apertures therein, said board being formed of low density material and having an upper surface and a lower surface, at least one of said surfaces having a plurality of slots therein said defining areas of reduced thickness separated by areas of at least a given thickness greater than said reduced thickness, at least some of apertures being coincident with at least some of said apertures; a material of higher density than the density of the board applied to at least one of said upper surface and said lower surface and extending through said apertures and filling said apertures and said slots; and a formed sheet affixed to the top side of the composite sheet.

18. A tile as defined in claim 17, wherein said formed sheet is water resistant.

19. A tile as defined in claim 17, wherein said composite sheet is generally planar with generally parallel side edges, and said formed sheet member comprises overhanging portions which project a predetermined distance beyond said underlying composite sheet along at least one side edge and one end edge thereof; and wherein said overhanging portions are adapted to cooperate in overlapping relationship with an adjacent tile or tiles.

20. A tile as defined in claim 19, further comprising attachment means to secure said composite sheet to a support means.

21. A tile as defined in claim 20, wherein said attachment means comprises at least one projection integral with said composite sheet and which is spaced from said overhanging portion, and at least one fastener to engage said projection.

22. A tile as defined in claim 20, wherein said formed sheet member is corrugated in a longitudinal direction of said composite sheet, and wherein said overhanging portions comprise at least one lateral overhanging portion projecting from at least one of said side edges of said composite sheet, and a longitudinal overhanging portion projecting from at least one end edge of said composite sheet.

23. A tile as defined in claim 21, wherein said lateral overhanging portion comprises one corrugation.

24. A tile as defined in claim 23, which is substantially rectangular.

25. A method of producing a composite sheet comprising providing an insulating board of low density material and of given thickness and having a first plurality of surface slots in its upper surface and a second plurality of slots in its lower surface, said slots having depths greater than one-half said given thickness to define apertures at intersections between slots in said upper surface and said lower surface; and filling the apertures and the slots with a high density material and covering at least one of said upper surface and said lower surface therewith.

26. A method as defined in claim 25, further including affixing a water-resistant formed sheet member to a top side thereof to form a tile.

27. A method as defined in claim 25, comprising providing overhanging portions of said sheet along at least one side edge and one end edge of said composite sheet.

28. A method as defined in claim 26, further comprising providing at least one projection integral with said composite sheet at an edge thereof other than said one side edge or said one end edge, said projection being adapted to receive a fastener.

29. The method as defined in claim 25, including pressing a scrim or nonwoven material into at least an upper or a lower surface of the high density material before it sets or hardens.

30. The method as defined in claim 25, including placing fibres in the high density material before filling the apertures and the slots with the high density material and covering at least one of said upper surface and said lower surface.

* * * * *